US007455163B2

(12) United States Patent
Yuyama et al.

(10) Patent No.: US 7,455,163 B2
(45) Date of Patent: Nov. 25, 2008

(54) TABLET PACKAGING DEVICE

(75) Inventors: Shoji Yuyama, Toyonaka (JP); Itsuo Yasunaga, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 357 days.

(21) Appl. No.: 10/551,131

(22) PCT Filed: Mar. 25, 2004

(86) PCT No.: PCT/JP2004/004172

§ 371 (c)(1),
(2), (4) Date: Sep. 29, 2005

(87) PCT Pub. No.: WO2004/089757

PCT Pub. Date: Oct. 21, 2004

(65) Prior Publication Data

US 2007/0022713 A1 Feb. 1, 2007

(30) Foreign Application Priority Data

Apr. 2, 2003 (JP) ..... 2003-099421

(51) Int. Cl.
*B65G 11/00* (2006.01)

(52) U.S. Cl. ..... 193/2 R; 221/6; 53/154

(58) Field of Classification Search ..... 193/2 R, 193/3, 14, 21, 23, 28, 29, 32; 221/6, 21, 221/124, 129; 53/154
See application file for complete search history.

(56) References Cited

U.S. PATENT DOCUMENTS 5,765,655 A * 6/1998 Tatsuoka ..... 193/2 R
5,787,678 A * 8/1998 Koike et al. ..... 221/124
6,202,385 B1 * 3/2001 Kim ..... 53/154
6,263,639 B1 7/2001 Kim
6,349,848 B1 * 2/2002 Uema et al. ..... 221/6
7,040,070 B2 * 5/2006 Yuyama et al. ..... 53/154

FOREIGN PATENT DOCUMENTS

| | | |
|---|---|---|
| JP | 61-153701 | 9/1986 |
| JP | 6-76148 | 10/1994 |
| JP | 2002-264902 | 9/2002 |

OTHER PUBLICATIONS

Taiwanese Office Action issued Mar. 14, 2008.
Supplementary European Search Report issued Feb. 29, 2008.

* cited by examiner

*Primary Examiner*—James R Bidwell
(74) *Attorney, Agent, or Firm*—Wenderoth, Lind & Ponack, L.L.P.

(57) ABSTRACT

A tablet packing apparatus arranged to prevent tablets from bouncing in a tablet drop guide path so that dropping time of the tablets can be shortened so as to be ready in time for packing. The tablet packing apparatus is provided with a tablet drop guide path (12) that guides tablets to a packing unit. The tablets drop obliquely downward from each of tablet outlets (10) of tablet feeders (8) provided in an up and down direction in a manner of a multistage shelf, wherein a bounce preventing member (14) is provided in a position opposing the tablet outlets of the tablet drop guide path, and the bounce preventing member (14) is obliquely provided so that it recedes from the tablet outlets 10 toward the lower end.

16 Claims, 8 Drawing Sheets

TABLET PACKAGING DEVICE

BACKGROUND OF THE INVENTION

1. Technical Field of the Invention

The present invention relates to a tablet packing apparatus.

2. Description of Related Art

In a medicine packing apparatus in which tablets and powder are dispensed in accordance with a prescription data and packed in a packing sheet by one dose and in a tablet packing apparatus in which tablets are dispensed and filled in a vial, there is provided a tablet cassette shelf on which a plurality of tablet cassettes containing different kinds of tablets respectively are mounted so that the tablets are dispensed one by one. In a back side plate of the tablet cassette shelf, there are provided tablet outlets that extend obliquely downward from the tablet cassettes and tablet drop guide paths that guide the tablets as they drop from the tablet outlets.

The tablet drop guide paths have three disadvantages. Firstly, a tablet that is dropping along the tablet drop guide path likely falls on an inclined plane of the tablet outlet of the lower tablet cassette and bounces upward, causing the drop of the tablet to be delayed. As a result, the tablet is not ready in time for packing and is packed in a subsequent package. Secondly, the tablet bounced on the inclined plane of the tablet outlet is likely detected by a sensor disposed in the tablet outlet, causing a false indication that the tablet has been discharged from the tablet outlet. To these disadvantages, an applicant of the present application has disclosed an idea in which a sheet member for covering the tablet outlet is attached on the upper edge of the tablet outlet in the tablet drop guide path so that the tablet dropping along the tablet drop guide path never falls on an inclined plane of the tablet outlet (for example, see Japanese journal of Technical Disclosure No. 97-6113). Thirdly, the tablet that exited from the tablet outlet bounces between the back side plate and a rear wall opposing the tablet outlet and drops, making the dropping time longer. As a result, the tablet is also not ready in time for packing and is packed in a subsequent package. To address this disadvantage, there has been proposed an idea in which a soft sheet is suspended in the tablet drop guide path so that the tablets hit on the soft sheet (for example, see Japanese Examined Utility Model Publication No. H2-15761).

However, in the idea in which the sheet member is attached on the tablet outlet, the sheet will likely cling to the back side plate in a dry state during the winter, thereby causing the small tablet to be collected therein. Further, when cleaning the tablet drop guide path and the light sensor in the tablet outlet using a brush or the like, the sheet member is likely deformed so as to lose the original function of the sheet member, resulting in a lot of time being required to repair it. On the other hand, in accordance with the arrangement in which the soft sheet is suspended in the tablet drop guide path, as a weight is attached on the lower end of the soft sheet, the soft sheet is apt to hold the vertical. Therefore, the light tablet bounces on the soft sheet, causing the same disadvantages as in the conventional arrangement.

SUMMARY OF THE INVENTION

The present invention is made in view of the conventional disadvantages. It is a object of the present invention to provide a tablet packing apparatus in which the tablets are prevented from bouncing in the tablet drop guide path so that the dropping time can be shortened. The tablet packing apparatus of the present invention that will be described hereinafter includes one that packs the tablets or powder in the packing sheet or one that fills and packs the tablets in the vial.

In order to solve the above problem, the first embodiment of the present invention provides a tablet packing apparatus provided with a tablet drop guide path that guides tablets to a packing unit, the tablets drop obliquely downward from each of tablet outlets of tablet feeders provided in an up and down direction in a manner of a multistage shelf, wherein a bounce preventing member is provided in a position opposing the tablet outlets of the tablet drop guide path, and wherein the bounce preventing member is obliquely provided so that it recedes from the tablet outlets toward the lower end.

It is preferable that the bounce preventing member comprises a flexible plate. In this case, any one end of the upper end and lower end of the bounce preventing member may be supported movably in a direction of thickness while the other end may be movable in a direction of thickness. Alternatively, any one end of the upper end and lower end of the bounce preventing member may be supported fixedly while the other end may be movable in a direction of thickness. It is also preferable that the bounce preventing member is detachable.

The second embodiment of the invention provides a tablet packing apparatus provided with a tablet drop guide path that guides tablets to a packing unit, the tablets drop obliquely downward from each of tablet outlets of tablet feeders provided in an up and down direction in a manner of a multistage shelf. A bounce preventing member is provided so as to extend obliquely from the lower edge of the upper-stage tablet outlet or the vicinity thereof to a position apart from the lower-stage tablet outlet.

It is preferable that the lower half portion of the bounce preventing member comprises a vertical portion. The bounce preventing member may comprise a cover portion extending from the lower end of it to the upper edge of the lower-stage tablet outlet. It is also preferable that the bounce preventing member is formed integrally with side walls of the tablet drop guide path.

The third embodiment of the invention provides a tablet packing apparatus provided with a tablet drop guide path that guides tablets to a packing unit. The tablets drop obliquely downward from each of tablet outlets of the tablet feeders provided in an up and down direction in a manner of a multistage shelf, comprising a bounce preventing member of the first embodiment of the invention described above and a bounce preventing member of the second embodiment of the invention described above.

EFFECT OF THE INVENTIONS

According to the first embodiment of the invention, a bounce preventing member is provided in a position opposing the tablet outlets of the tablet drop guide path, and the bounce preventing member is obliquely provided so that it recedes from the tablet outlets toward the lower end. Thus, a bounce angle of the tablet is suppressed, allowing the tablets to free fall downward without bouncing many times so that the dropping time can be shortened. As a result, it is possible to promptly pack the tablet dropped through the tablet drop guide path and to eliminate a possibility that the tablet will contaminate the next package, allowing perfect and reliable packaging to be conducted.

As the bounce preventing member comprises a flexible plate, the shock when the tablet hits against the bounce preventing member is absorbed so that bounce of the tablet can be suppressed. Since either of the upper end and the lower end of the bounce preventing member is supported movably in a direction of thickness while the other end is movable in a direction of thickness; alternatively, any one end of the upper end and the lower end of the bounce preventing member is supported fixedly while the other end is movable in a direction of thickness such that, when the tablet hits on the bounce preventing member, the latter recedes to absorb the shock so that bounce of the tablet can be more effectively suppressed. Since the bounce preventing member is detachable, when it is removed, the tablet drop guide path can be easily cleaned.

According to the second invention, a bounce preventing member is provided so as to extend obliquely from the lower edge of the upper-stage tablet outlet or the vicinity thereof to a position apart from the lower-stage tablet outlet. Thus, even if the tablets bounce in the tablet drop guide path and drop toward the tablet outlet, all of the tablets are bounced downward by the bounce preventing member, allowing the tablet to free fall downward without bouncing many times so that the dropping time can be shortened. As a result, in the same manner as the first invention, it is possible to promptly pack the tablet dropped through the tablet drop guide path and to eliminate a possibility that the tablet will contaminate the next package, allowing perfect and reliable packaging to be conducted.

Since the lower half portion of the bounce preventing member comprises a vertical portion, all of the tablets dropping toward the vertical portion can be bounced downward, allowing the dropping time to be further shortened. As the bounce preventing member is formed integrally with side walls of the tablet drop guide path, the number of parts is reduced, thereby making it easy to attach.

According to the third embodiment of the invention, both a bounce preventing member of the first embodiment of the invention and a bounce preventing member of the second embodiment of the invention are provided. Thus, due to the synergistic effect of both bounce preventing effects, the dropping time of the tablets can be further shortened, thereby enhancing the packing speed and preventing the tablet from contaminating the next package.

DETAILED DESCRIPTION OF THE INVENTION

Hereinafter, embodiments according to the present invention will be described in accordance with the accompanying drawings.

Figure 1:
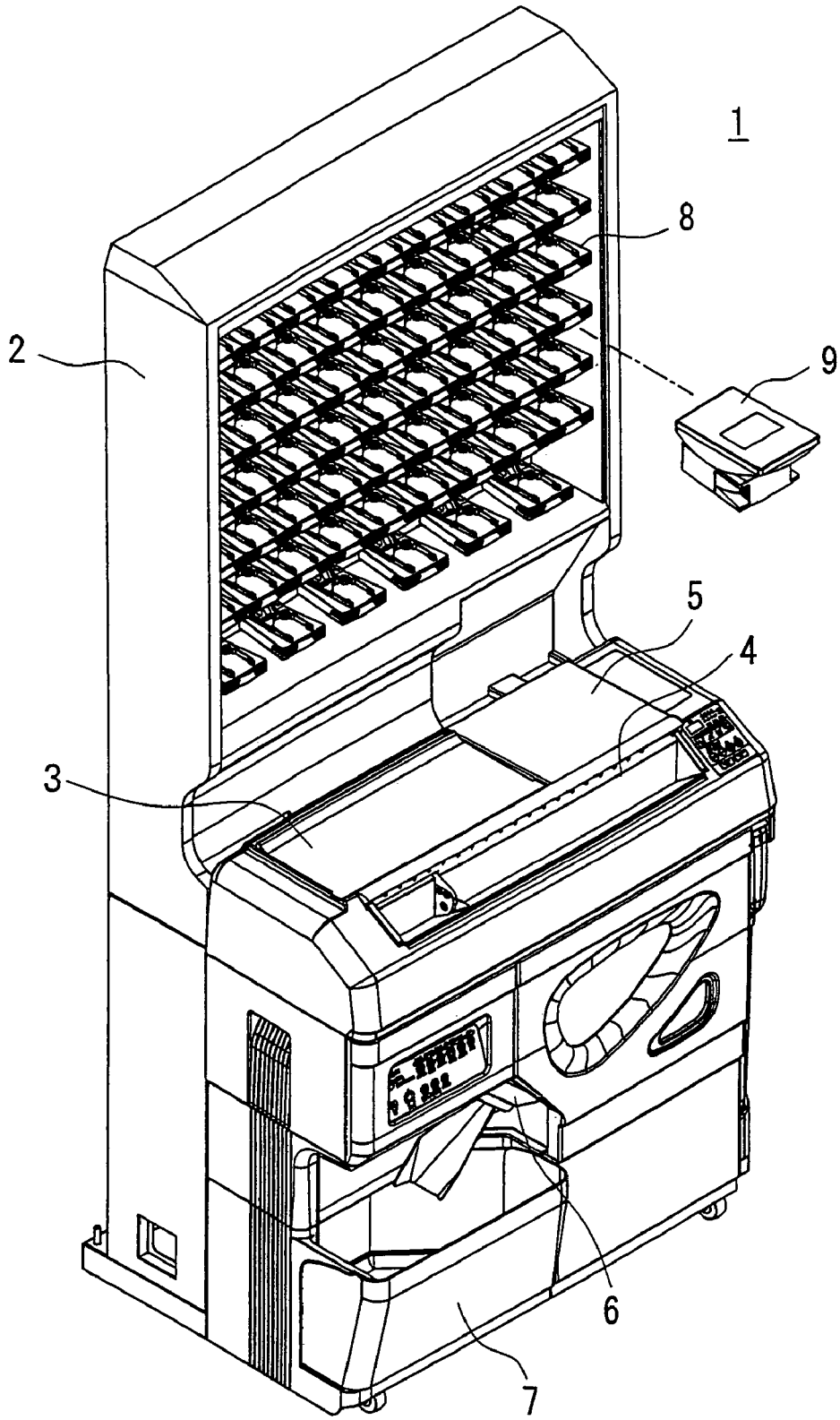
FIG. 1 is a perspective view of a medicine packing apparatus according to the present invention.

FIG. 1 shows a medicine packing apparatus 1 according to the first embodiment of the invention. On the back surface, the medicine packing apparatus 1 is combined with a tablet cassette shelf 2. On the upper surface, a tablet manual distributing unit 3, a V-shaped box 4 in which powder is poured and a control unit 5 are provided. In the lower portion of the front surface, a medicine package belt discharge portion 6 and a box 7 for containing a medicine package belt discharged from the medicine package belt discharge portion 6 are provided.

In the medicine packing apparatus 1, known units (not shown) such as a division container for dividing the powder poured in the V-shaped box 4, a hopper for collecting the powder dropping from the division container and the tablets dropping from the tablet manual distributing unit 3, and a packing unit for packing the medicine collected by the hopper to discharge it through a medicine package belt discharge portion 6, and so on are provided.

Figure 2:
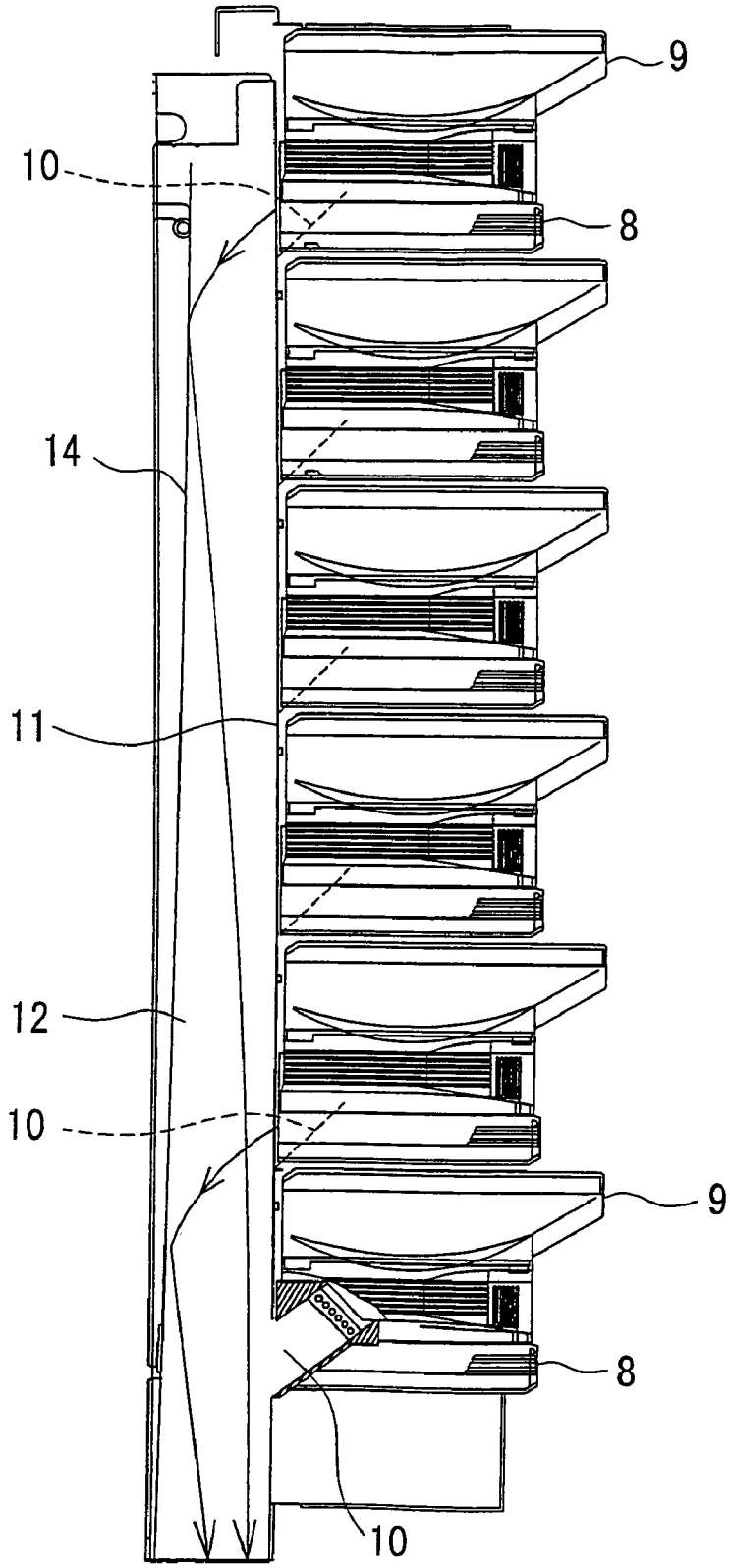
FIG. 2 is a sectional view of a tablet drop guide path provided with a bounce preventing plate according to a first embodiment of the invention.

On the tablet cassette shelf 2, a plurality of tablet feeders (motor bases) 8 are attached in a manner of a multistage shelf. On the tablet feeders 8 are mounted a plurality of tablet cassettes 9, which contain different kinds of tablets, respectively. Operation of the tablet feeder 8 allows the tablets in each of the plurality of tablet cassettes 9 to be taken out one by one from a tablet outlet 10, as shown in FIG. 2. The tablets are collected in the hopper through a tablet drop guide path 12 provided on a back surface plate 11 of the cassette shelf 2 and packed by the packing unit.

Figure 3:
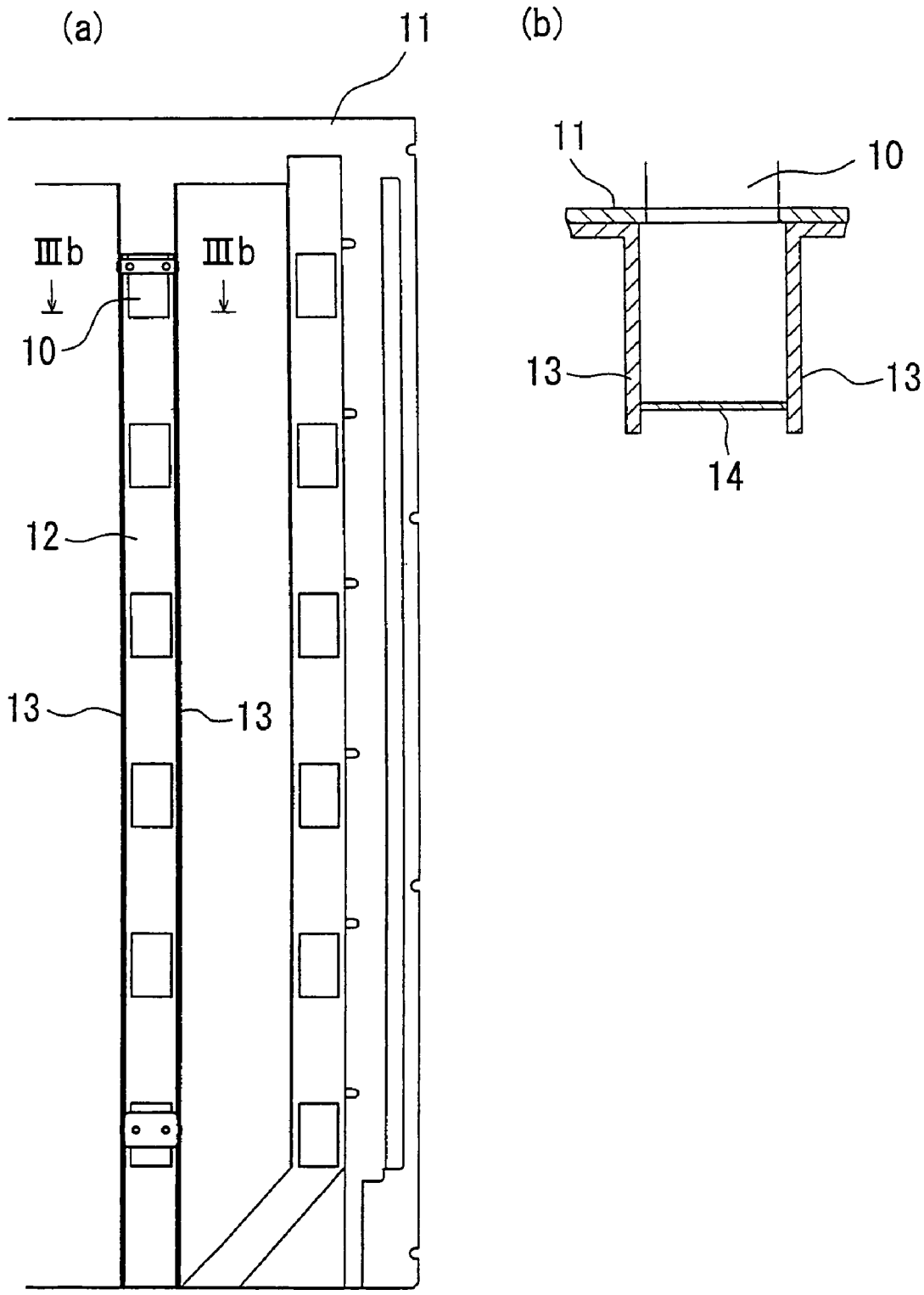
FIG. 3(*a*) is a back side view of the tablet drop guide path of FIG. 2, and FIG. 3(*b*) is a sectional view taken along IIIb-IIIb of FIG. 3(*a*)
Figure 4:
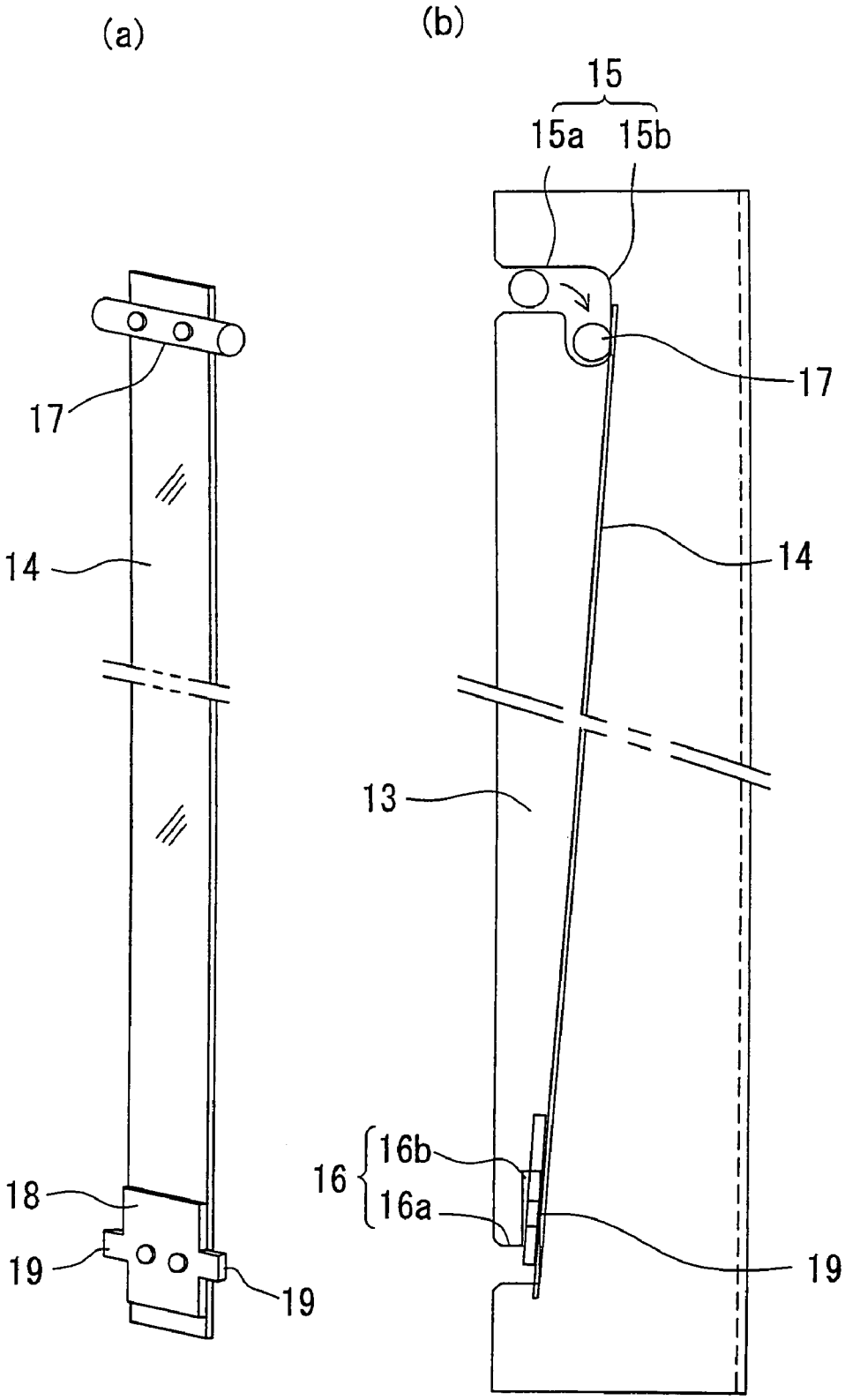
FIG. 4(*a*) is a perspective view of the bounce preventing plate, and FIG. 4(*b*) is an enlarged view showing an attaching portion of the bounce preventing plate.

The tablet drop guide path 12, as shown in FIG. 3, comprises two side walls 13 positioned at both sides of the tablet outlets 10 of the back side plate 11 and a bounce preventing plate 14 opposing the tablet outlets 10 of the back side plate 11. The side walls 13 in the present embodiment have an L-shaped cross section made of stainless steel and are screwed on the back surface plate 11. As shown in FIG. 4, on the upper end portion of each of the side walls 13 is formed a first cutout 15, which comprises a horizontal portion 15*a* extending horizontally from the vertical edge and a vertical portion 15*b* extending downwardly from the end of the horizontal portion 15*a*. On the lower portion is formed a second cutout 16 which comprises a horizontal portion 16*a* extending horizontally from the vertical edge and a vertical portion 16*b* extending upwardly from the end of the horizontal portion 16*a*. The horizontal portion 15*a* of the first cutout 15 is longer than the horizontal portion 16*a* of the second cutout 16. The vertical portion 11*b* of the first cutout 15 is shorter than the vertical portion 16*b* of the second cutout 16. Further, the first cutout 15 has a width in which a support bar 17 on the upper end of the bounce preventing plate 14 can enter. The second cutout 16 has a width in which an engagement protrusion 19 on the lower end of the bounce preventing plate 14 can enter.

The bounce preventing plate 14 in this embodiment, as shown in FIG. 4(*a*), is made of transparent flexible resin and formed in an elongate plate-like shape having a width that is smaller than the distance of the side walls 13. In the vicinity of the upper end of the bounce preventing plate 14 is screwed a support bar 17, which comprises a stainless steel round bar and has a length such that both ends protrude from the side ends of the bounce preventing plate 14. In the vicinity of the lower end of the bounce preventing plate 14 is screwed an engagement plate 18 comprising a stainless steel plate. On both side edges of the engagement plate 18, engagement protrusions 19 are provided so as to protrude from the side edges of the bounce preventing plate 14. The length from the support bar 17 to the engagement protrusion 19 is shorter than that from the lower end of the vertical portion 15*b* of the first cutout 15 to the horizontal portion 16*a* of the second cutout 16.

The engagement protrusions 19, at the lower end of the bounce preventing plate 14, are inserted in the horizontal portions 16*a* of the second cutouts 16 and pull up to the vertical portions 16*b*. In this state, both ends of the support bar 17 at the upper end are inserted in the horizontal portions 15*a* of the first cutouts 15 and dropped in the vertical portions 15*b*. Thus, the bounce preventing plate 14 is obliquely attached so that it recedes from the tablet outlets 10 of the back surface plate 11 of the tablet cassette shelf 2 toward the lower end. The upper end portion of the bounce preventing plate 14 is movable by a gap between the support bar 17 and the vertical portions 15*b* of the first cutouts 15. The lower end portion is movable by a gap between the engagement protrusions 19 and the vertical portions 16*b* of the second cutout 16. As the bounce preventing plate 14 has flexibility, the support bar 17 at the upper end is rotatable to some extent within the vertical portions 15*b* of the first cutout 15, and the engagement protrusions 19 at the lower end are movable up and down.

Figure 5:
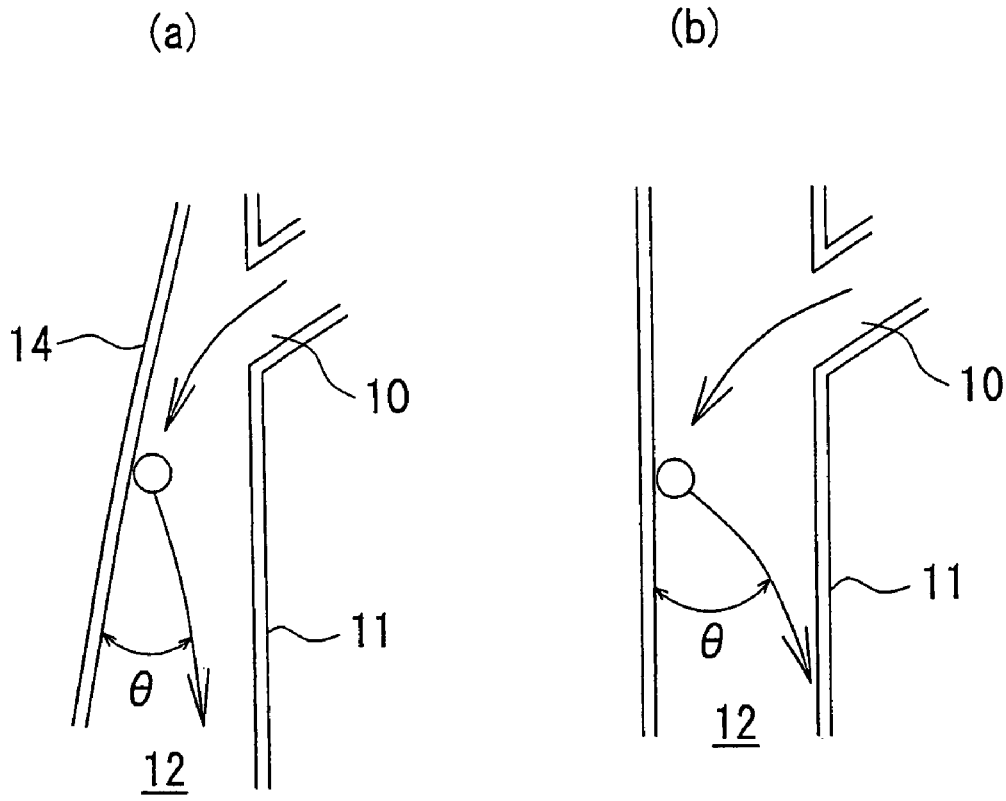
FIG. 5(*a*) is a schematic view showing a state in which the tablet is bouncing in the tablet drop guide path having the bounce preventing plate, and FIG. 5(*b*) is a schematic view showing a state in which the tablet is bouncing in the conventional tablet drop guide path having no bounce preventing plate.

A tablet dropping from the tablet outlet 10 of the tablet feeder 8, as shown in FIG. 2, bounces first on the bounce preventing plate 14 and then free falls directly through the tablet drop guide path 12 without bouncing on the back surface plate 11. This is due to the following two reasons. Firstly, since the bounce preventing plate 14 is inclined so as to recede from the tablet outlets 10 toward the lower end as shown in FIG. 5(*a*), a bounce angle θ is small in comparison with that of the conventional device as shown in FIG. 5(*b*). Secondly, since the bounce preventing plate 14 has flexibility and is movable in a direction perpendicular to the surface, the shock when the tablet hits against the bounce preventing plate 14 is absorbed. Therefore, the tablet is prevented from bouncing many times within the tablet drop guide path as in the conventional device. Thus, the dropping time becomes shorter and the tablet can be ready in time for packing. Therefore, the conventional disadvantages that the drop of the tablet is delayed and the tablet is packed in a subsequent package can be eliminated.

Figure 6:
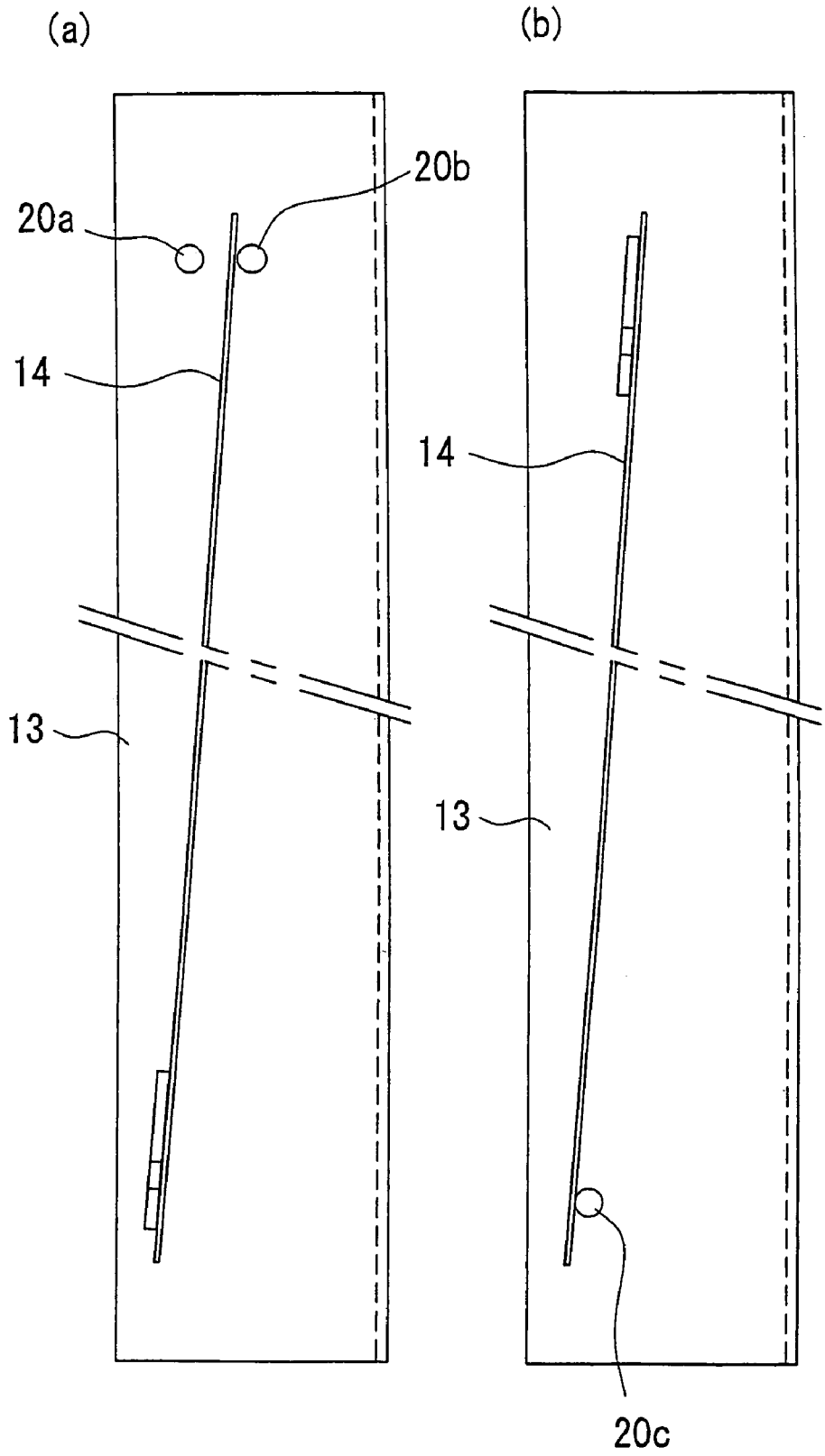
FIG. 6(*a*) is an enlarged view showing an another example of the attaching portion of the bounce preventing plate, and FIG. 6(*b*) is an enlarged view showing another example.

FIGS. 6(*a*)-6(*b*) show a variation of the support structure of the bounce preventing plate 14. The upper end of the bounce preventing plate 14 of FIG. 6(*a*) is inserted between two pins 20*a*, 20*b* so as to be movable in a direction of thickness while the lower end is fixed to the side walls 13 by appropriate means such as screws, adhesive, two-sided tape and so on. The upper end of the bounce preventing plate 14 of FIG. 6(*b*) is fixed to the side walls 13 by appropriate means such as screws, adhesive, two-sided tape and so on while the lower end comes into contact with a pin 20*c* so as to be movable in a direction of thickness. Since the bounce preventing plate 14 is movable in a direction of thickness, it retreats as the tablet hits, thereby suppressing the bounce.

Figure 8:
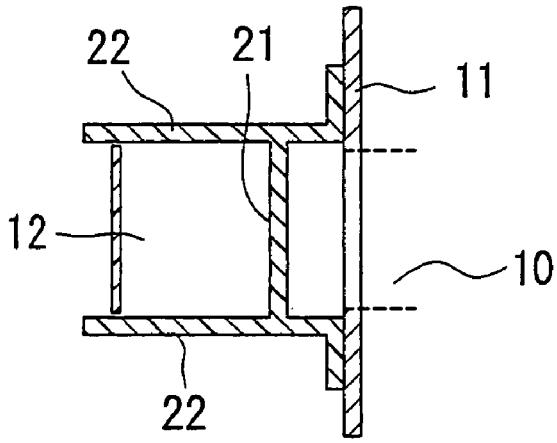
FIG. 8 is a sectional view taken along VIII-VIII of FIG. 7(*a*)
Figure 7:
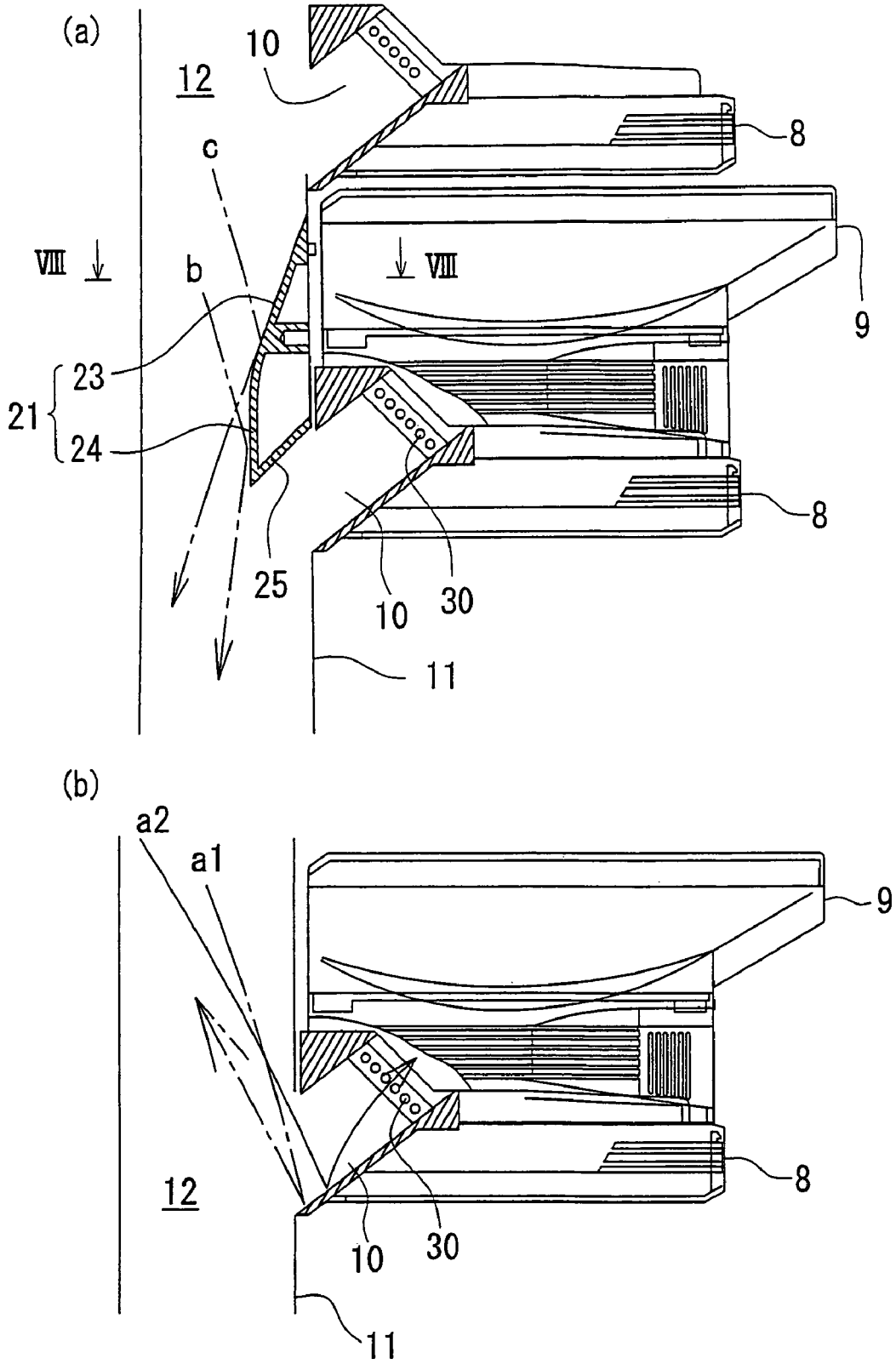
FIG. 7(*a*) is a sectional view of a tablet drop guide path provided with a bounce preventing member according to a second embodiment of the invention, and FIG. 7(*b*) is a sectional view of a tablet drop guide path having no bounce preventing member.

FIG. 7(*a*) shows the tablet drop guide path 12 of the medicine packing apparatus according to a second embodiment of the invention. The tablet drop guide path 12 is provided with a bounce preventing member 21 above each of the tablet outlets 10 of the tablet feeders 8. The bounce preventing member 21 is made of synthetic resin and formed integrally with both side walls 22 as shown in FIG. 8. The side walls are made of synthetic resin and form the tablet drop guide path 12. The bounce preventing member 21 is screwed on the back surface plate 11. The bounce preventing member 21 extends obliquely from the lower edge of the upper-stage tablet outlet 10 or the vicinity thereof to a position apart from the lower-stage tablet outlet 10. The upper half part of the bounce preventing member 21 is an inclined portion 23 and the lower half part is a vertical portion 24 extending parallel to the tablet drop guide path 12. In addition, the bounce preventing member 21 has a cover portion 25 extending from the lower end of it to the upper edge of the lower-stage tablet outlet 10.

Assuming that there is no such bounce preventing member 21, the tablet that drops toward the lower edge of the tablet outlet 10 bounces up as shown in an "a1" course in FIG. 7(*b*), delaying the dropping time. Otherwise, as shown in an "a2" course in FIG. 7(*b*), the tablet is detected by a sensor 30 disposed in the tablet outlet 10, causing a false determination that the tablet has been discharged from the tablet outlet 10, resulting in a possibility of false operation. However, in the present embodiment, since the bounce preventing member 21 exists, even if the tablet drops toward the lower edge of the tablet outlet 10, the tablet bounces on the vertical portion 24 of the bounce preventing member 21 as shown in "b" course in FIG. 7(*a*) to drop downward. Also, the tablet drops toward the inclined portion 23 of the bounce preventing member 21 bounces on the inclined portion 23 to drop downward. Thus, since all of the tablets dropping toward the vicinity of the tablet outlet 10 bounce downward, the dropping time is not delayed and the tablet can be ready in time for packing. Therefore, in this embodiment, the conventional disadvantages that the drop of the tablet is delayed and the tablet is packed in a subsequent package can also be eliminated.

Figure 9:
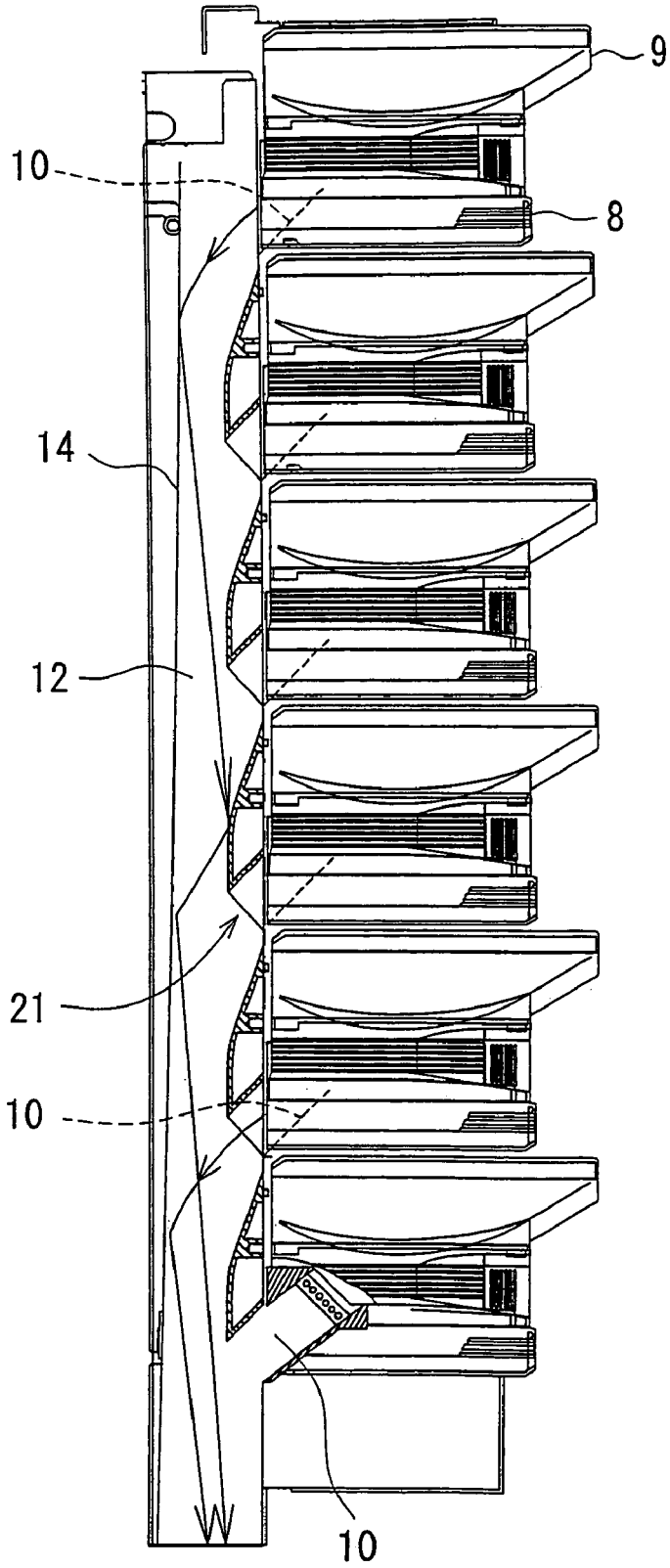
FIG. 9 is a sectional view of a tablet drop guide path according to a third embodiment of the invention provided with the bounce preventing plate according to the first embodiment of the invention and the bounce preventing member according to the second embodiment of the invention.

FIG. 9 shows the tablet drop guide path 12 of the medicine packing apparatus according to a third embodiment of the invention. The tablet drop guide path 12 has the bounce preventing plate 14 as shown in FIG. 1 and the bounce preventing member 21 as shown in FIG. 7(*a*). Therefore, according to the synergistic effect of both bounce preventing effects, the tablet promptly passes through the tablet drop guide path 12 to be directed to the lower packing unit, enhancing the packing speed and reducing packing defects such as contamination of the tablet into the next package.

The invention claimed is:

1. A tablet packing apparatus comprising:

a plurality of tablet feeders arranged in an up and down direction so as to form a multistage shelf, each of the tablet feeders having a tablet outlet;

a tablet drop guide path for receiving tablets from the tablet feeders and guiding the tablets to a packing unit, wherein the tablet outlets are arranged so that the tablets drop obliquely downward into the tablet drop guide path from each of tablet outlets of the tablet feeders; and a bounce preventing member disposed in the tablet drop guide path and positioned so as to oppose the tablet outlets of the tablet feeders, wherein the bounce preventing member is obliquely provided with respect to a vertical plumb line of the tablet drop guide path so that it recedes from the tablet outlets in a direction toward a lower end thereof.

2. The tablet packing apparatus as in claim 1, wherein the bounce preventing member comprises a flexible plate.

3. The tablet packing apparatus as in claim 2, wherein any one end of the upper end and lower end of the bounce preventing member is supported movably in a direction of thickness while the other end is movable in a direction of thickness.

4. The tablet packing apparatus as in claim 2, wherein anyone end of the upper end and lower end of the bounce preventing member is supported fixedly while the other end is movable in a direction of thickness.

5. The tablet packing apparatus as in claim 1, wherein the bounce preventing member is detachable.

6. A tablet packing apparatus comprising:

a plurality of tablet feeders arranged in an up and down direction so as to form a multistage shelf, wherein each of the tablet feeders includes a tablet outlet;

a tablet drop guide path for guiding tablets fed from the tablet feeders to a packing unit, wherein the tablet outlets of the tablet feeders are arranged such that the tablets will drop obliquely downward into the tablet drop guide path from each of tablet outlets of the tablet feeders; and a bounce preventing member is provided so as to extend obliquely from a lower edge of an upper-stage tablet outlet or the vicinity thereof to a position apart from a lower-stage tablet outlet.

7. The tablet packing apparatus as in claim 6, wherein a lower half portion of the bounce preventing member comprises a vertical portion.

8. The tablet packing apparatus as in claim 6, wherein the bounce preventing member comprises a cover portion extending from the lower end of it to the upper edge of the lower-stage tablet outlet.

9. The tablet packing apparatus as in claim 6, wherein the bounce preventing member is formed integrally with side walls of the tablet drop guide path.

10. A tablet packing apparatus as in claim 1, further comprising a second bounce preventing member provided so as to extend obliquely from a lower edge of an upper-stage tablet outlet or the vicinity thereof to a position apart from the lower-stage tablet outlet.

11. The tablet packing apparatus as in claim 2, wherein the bounce preventing member is detachable.

12. The tablet packing apparatus as in claim 3, wherein the bounce preventing member is detachable.

13. The tablet packing apparatus as in claim 4, wherein the bounce preventing member is detachable.

14. The tablet packing apparatus as in claim 7, wherein the bounce preventing member comprises a cover portion extending from the lower end of it to the upper edge of the lower-stage tablet outlet.

15. The tablet packing apparatus as in claim 7, wherein the bounce preventing member is formed integrally with side walls of the tablet drop guide path.

16. The tablet packing apparatus as in claim 8, wherein the bounce preventing member is formed integrally with side walls of the tablet drop guide path.

* * * * *